US007562785B2

(12) United States Patent
Meissen

(10) Patent No.: US 7,562,785 B2
(45) Date of Patent: Jul. 21, 2009

(54) BOTTLE CASE

(75) Inventor: Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 267 days.

(21) Appl. No.: 11/134,075

(22) Filed: May 20, 2005

(65) Prior Publication Data

US 2005/0274639 A1 Dec. 15, 2005

Related U.S. Application Data

(60) Provisional application No. 60/573,048, filed on May 21, 2004.

(51) Int. Cl.
*B65D 6/24* (2006.01)
*B65D 85/00* (2006.01)

(52) U.S. Cl. ..... 220/6; 220/4.28; 220/509

(58) Field of Classification Search ..... 220/4.29, 220/519, 515, 512, 510, 509, 507, 625, 676, 220/666, 822, DIG. 2, DIG. 15, 23.86; 206/218, 206/563, 562
See application file for complete search history.

(56) References Cited

U.S. PATENT DOCUMENTS 285,386 A * 9/1883 Burton ..... 211/74
820,445 A * 5/1906 Speer ..... 220/509
855,565 A * 6/1907 Greenhouse ..... 206/562
975,962 A * 11/1910 Kruse ..... 217/21
1,370,525 A * 3/1921 Eisenkraft ..... 206/562
1,730,345 A * 10/1929 Beman ..... 211/74
1,987,764 A * 1/1935 Walker et al. ..... 220/612
2,406,756 A * 9/1946 Fox ..... 220/6
2,459,921 A * 1/1949 Comer ..... 220/512
D168,307 S * 12/1952 Lenard ..... D6/469
3,381,879 A * 5/1968 Belcher et al. ..... 229/166
4,947,991 A * 8/1990 Snell ..... 206/427
5,419,455 A * 5/1995 Russeau ..... 220/575
6,283,566 B1 * 9/2001 Doces ..... 312/351
7,334,908 B1 * 2/2008 Figueroa ..... 362/101
2005/0263464 A1 * 12/2005 Nunn ..... 211/74

* cited by examiner

*Primary Examiner*—Anthony D Stashick
*Assistant Examiner*—Robert J Hicks
(74) *Attorney, Agent, or Firm*—Carlson, Gaskey & Olds, P.C.

(57) ABSTRACT

A case includes removable upper side walls and collapsible upper end walls. The upper side walls each include a central opening for supporting the upper side wall horizontally on a bottle and a plurality of peripheral openings on which empty glasses may be supported. Each of the upper end walls includes a plurality of openings for supporting bottles in a vertical position when the upper end wall is in the collapsed position.

23 Claims, 3 Drawing Sheets

BOTTLE CASE

CROSS REFERENCE TO RELATED APPLICATION

This application claims the benefit of and priority to provisional application Ser. No. 60/573,048, filed on May 21, 2004.

BACKGROUND OF THE INVENTION

The present invention relates generally to a case for carrying bottles and more particularly to a reusable case for bottles, such as wine bottles, the case having collapsible walls and detachable members for holding accessories, such as wine glasses.

Wine bottles are typically shipped in cardboard boxes to stores. The wine bottles are often displayed for sale in the store in the boxes. Consumers who purchase a case of wine carry the bottles home in the cardboard boxes. These boxes are typically not sturdy and may be subject to damage from water, the environment, etc. These boxes are typically not reused or returned to the store.

SUMMARY OF THE INVENTION

The present invention provides a molded plastic bottle case that is more durable, reusable, and provides additional functionality not found in the previously known boxes.

The bottle case includes a pair of lower end walls and a pair of lower side walls integrally molded with a bottom wall. An upper side wall is mounted above each lower side wall and is detachable from the bottle case. Each upper side wall includes a central opening for receiving a bottle. After removal from the bottle case, the upper side wall can be used as a glass holder. The central opening of the upper side wall is supported on the neck of a bottle and the stems of the glasses are received in the peripheral openings.

Upper end walls are collapsible (after removal of the upper side walls) to a position supported on the lower side walls. In the collapsed position, the upper end walls support bottles in each of a plurality of openings. The remaining area inside the case can be used as a cooler or storage container and may be filled with ice and/or food.

BRIEF DESCRIPTION OF THE DRAWINGS

Other advantages of the present invention can be understood by reference to the following detailed description when considered in connection with the accompanying drawings wherein.

DETAILED DESCRIPTION OF A PREFERRED EMBODIMENT

Figure 1:
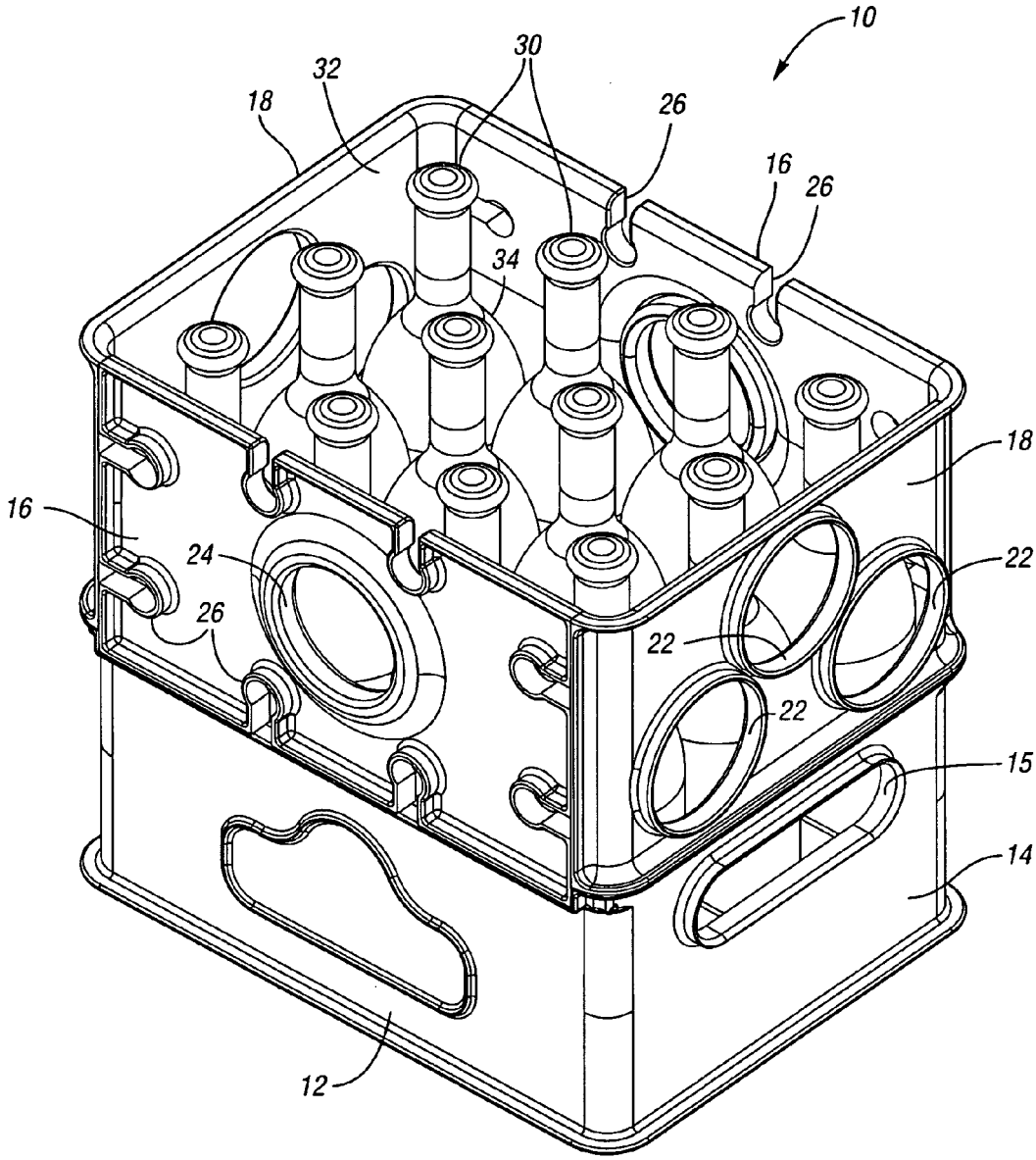
FIG. 1 is a perspective view of a bottle case according to the present invention containing a dozen bottles.

A bottle case 10 according to the present invention is illustrated in FIG. 1. Although the case 10 will be illustrated for use with wine bottles, it could be used with any type of bottles or other beverage containers. The case 10 includes lower side walls 12 and lower end walls 14 extending upwardly from a periphery of a bottom wall 13 (visible in FIG. 2). The case 10 further includes a pair of upper side walls 16 generally vertically aligned with and detachably mounted on top of lower side walls 12 and upper end walls 18 generally vertically aligned on lower end walls 14. The lower end walls 14 each include a handle opening 15. The upper end walls 18 each include a plurality of openings 22. Each of the upper side walls 16 includes a central opening 24 and at least one peripheral opening 26 (eight openings 26 being shown in FIG. 3.)

In FIG. 1, the case 10 is shown containing a dozen bottles 30 (in this example, wine bottles 30). Each of the bottles 30 in the case 10 includes a neck 32 extending upwardly from a body portion 34.

Figure 2:
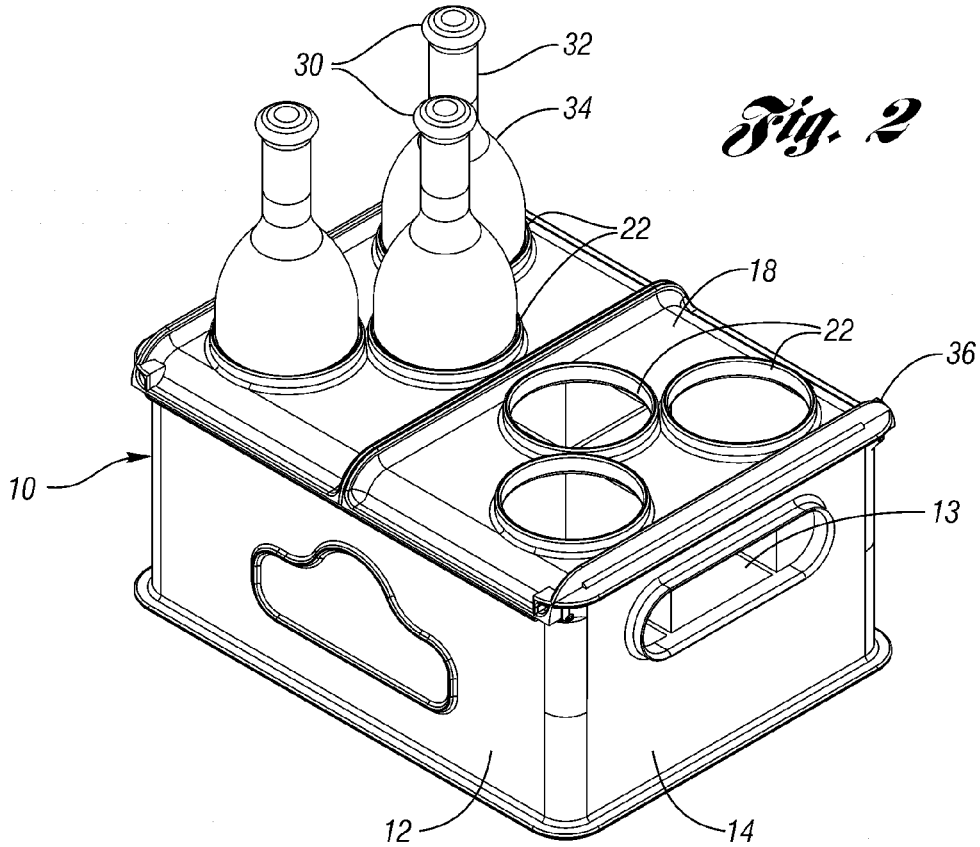
FIG. 2 is a perspective view of the bottle case of FIG. 1 with the upper side walls removed and the upper end walls pivoted to the collapsed position.

In use, the bottles 30 (a dozen shown) are shipped to the store in case 10. A consumer purchases the bottles 30 and takes them home in the case 10. The consumer then removes the upper side walls 16 and folds down the upper end walls 18 into a collapsed position as shown in FIG. 2. The upper end walls 18 are pivoted about living hinges 36 on lower end walls 14 and supported on the upper edges of lower side walls 12. Some of the bottles 30 can be supported in an upright position in the case 10 in the openings 22 in the upper end walls 18, leaving additional room in the case 10 for ice and food for a picnic. The case 10, ice, food and bottles 30 can be carried to the dining location and displayed at the dining location.

Figure 3:
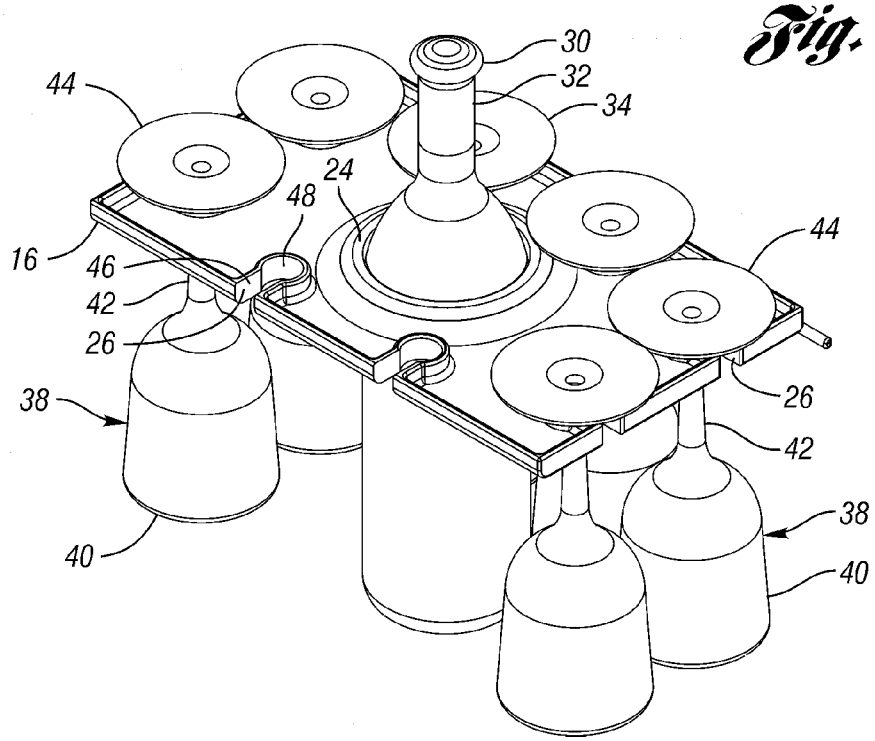
FIG. 3 is a perspective view of one of the upper side walls of the bottle case of FIG. 1 supported on a bottle and supporting a plurality of glasses.

Meanwhile, the upper side walls 16 can each be supported on one of the bottles 30, as shown in FIG. 3. The neck 32 of the bottle 30 is inserted into the central opening 24 and the upper side wall 16 is supported on the body portion 34 of the bottle 30. While supported on the bottle 30, the upper side wall 16 may also support other accessories, such as glasses 38. Glasses 38 each have a cup portion 40 supported by a stem 42 on a base 44. The stem 42 of a glass 38 can be inserted the peripheral opening 26 in the upper side wall 16. The peripheral opening 26 includes a slot opening 46 leading to a slightly larger round opening 48. Stem 42 is inserted through the slot opening 46 and retained in the round opening 48 of the peripheral opening 26. In this manner, as shown in FIG. 3, the upper side wall 16 can hold a plurality of glasses 38 while being supported on a bottle 30.

Figure 4:
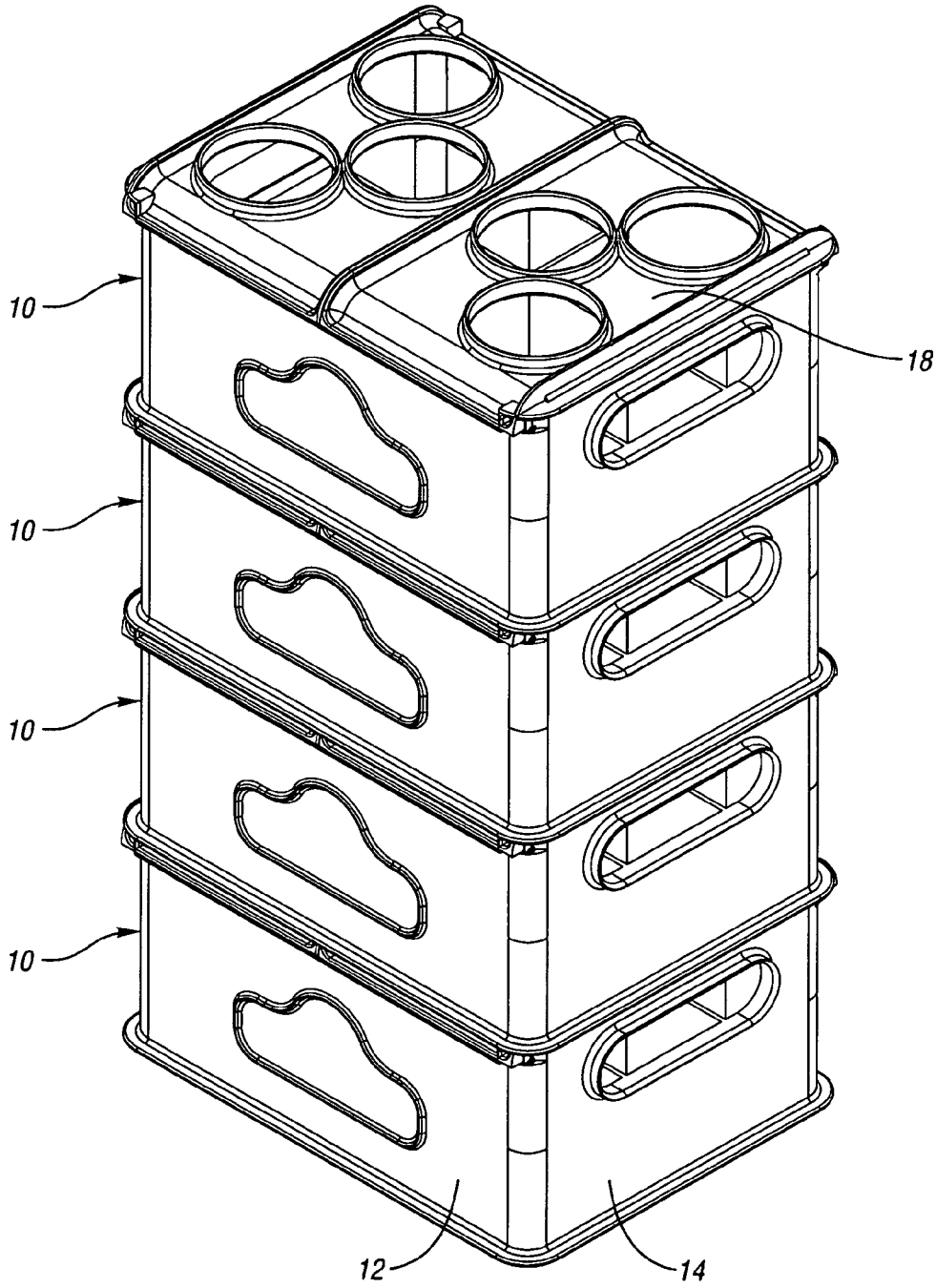
FIG. 4 illustrates a plurality of bottle cases similar to the bottle case shown in FIG. 1, stacked upon one another with the upper end walls in the collapsed position.

When empty, the case 10 can be stacked with similar cases 10, as shown in FIG. 4. The upper end walls 18 are pivoted to their collapsed position as shown to reduce the overall stacking height of the empty cases 10. The upper side walls 16 may be simply placed inside the cases 10. The empty cases 10 may then be shipped back to the beverage producers for reuse.

Alternatively, without the central opening 24, the upper side wall 16 can be used as an individual plate, the upper surface of which can support food in addition to a glass 38. In such an embodiment, only one peripheral openings 26 may be necessary, so that a user could hold the upper side wall 16 as a plate and support a glass (with beverage) on the peripheral opening 26.

The case 10 may be formed of polypropylene, HDPE, polycarbonate or other suitable material via an injection molding or other suitable process. Although not shown, small interlocking tabs or snap-fit tabs around the edges of the upper side walls 16 may detachably connect the upper side walls 16 to the lower side walls 12 and the adjacent upper end walls 18. Other means of detachably connecting the upper side walls 16 could also be utilized, which may or may not permit reattachment of the upper side walls 16. Although illustrated for use with wine bottles 30 and wine glasses 38, for which the present invention is particularly well-suited, the case 10 could also be used with other beverage containers and other accessories.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A bottle case comprising:

a bottom wall;

a lower wall portion extending upward vertically from the bottom wall; and at least one removable vertical wall portion extending upward vertically from the lower wall portion, the removable vertical wall portion having a first opening for receiving a portion of a bottle and having a portion for being supported on a bottle, the removable vertical wall portion including an accessory holder, the removable vertical wall portion selectively detachable from the lower wall portion.

2. The bottle case of claim 1 wherein the accessory holder includes a second opening for receiving an accessory.

3. The bottle case of claim 2 and the bottle, wherein the bottle includes a neck portion and a body portion wider than the neck portion, the first opening larger than the neck portion and smaller than the body portion.

4. The bottle case and bottle of claim 3 wherein the second opening is a peripheral opening.

5. The bottle case and bottle of claim 4 wherein the second opening is one of a plurality of second openings, each opening through a periphery of the removable vertical wall portion.

6. The bottle case and bottle of claim 5 wherein the plurality of second openings each include a narrow slot portion and a wide portion.

7. The bottle case and bottle of claim 6 wherein the bottle is disposed in the first opening of the removable vertical wall portion.

8. The bottle case and bottle of claim 7 and a glass having a stem and a body, the stem of the glass received in one of the second openings.

9. The bottle case of claim 1 further including a collapsible wall portion pivotable between an upright position and a collapsed position, the collapsible wall portion having at least one opening for supporting a bottle in a vertical position on the bottom wall when the at least one collapsible wall portion is in a collapsed position.

10. The bottle case of claim 9 wherein the collapsible wall portion is pivotably connected to the bottom wall.

11. A bottle case comprising:

a bottom wall;

a lower first wall portion extending upwardly from the bottom wall;

a lower second wall portion extending upwardly from the bottom wall;

a collapsible wall portion pivotably connected to the first wall portion and pivotable between an upright position and a collapsed position and having an opening for receiving a bottle therethrough; and a removable vertical wall portion removably attachedto and completely detachable from the second wall portion and separable and completely detachable from the collapsible wall portion, the removable vertical wall portion being securable to a bottle.

12. The bottle case of claim 11 wherein the removable vertical wall portion includes an opening therethrough for receiving the bottle.

13. The bottle case of claim 12 wherein the removable vertical wall portion includes a plurality of accessory openings, each opening through a periphery of the removable vertical wall portion.

14. The bottle case of claim 13 wherein each accessory opening includes a slot portion adjacent the periphery and a wide portion contiguous with the slot portion.

15. An accessory holder, bottle and glass comprising: a wall having a opening therethrough for receiving a bottle;

a plurality of accessory openings, each opening through a periphery of the wall;

a bottle having a neck and a body, the neck extending through the opening in the wall, the opening narrower than the body, and the wall having a portion supported on the bottle; and a glass having a stem between a cup portion and a base, the stem of the glass received in one of the accessory openings.

16. The accessory holder of claim 15 wherein each accessory opening includes a slot portion adjacent the periphery and a wide portion contiguous with the slot portion.

17. The accessory holder of claim 15 wherein the accessory openings are narrower than the base of the glass.

18. The bottle case of claim 8 further including a collapsible wall portion pivotable between an upright position and a collapsed position, the collapsible wall portion having at least one opening sized to receive the bottle in a vertical position on the bottom wall when the at least one collapsible wall portion is in the collapsed position.

19. The bottle case of claim 1 wherein the lower wall portion includes a pair of lower side walls and lower end walls integrally molded with and extending upwardly from a periphery of the bottom wall.

20. The bottle case of claim 19 wherein the portion for being supported on a bottle is adjacent the opening for receiving the bottle.

21. The bottle case of claim 19 wherein the at least one removable vertical wall portion includes a pair of removable vertical wall portions detachably mounted in a vertical orientation to upper edges of the lower side walls.

22. The bottle case of claim 21 further including a pair of upper end walls mounted on upper edges of the lower end walls.

23. The bottle case of claim 22 wherein the upper end walls are movable from an upright position to a generally horizontal collapsed position on the lower side walls.

* * * * *

UNITED STATES PATENT AND TRADEMARK OFFICE

CERTIFICATE OF CORRECTION

PATENT NO. : 7,562,785 B2
APPLICATION NO. : 11/134075
DATED : July 21, 2009
INVENTOR(S) : Meissen It is certified that error appears in the above-identified patent and that said Letters Patent is hereby corrected as shown below:

In Claim 11, Column 4, Line 5, please change "attachedto" to read as --attached to--

Signed and Sealed this

First Day of September, 2009

David J. Kappos

David J. Kappos
*Director of the United States Patent and Trademark Office*